US008389075B2

(12) United States Patent
Looman et al.

(10) Patent No.: US 8,389,075 B2
(45) Date of Patent: Mar. 5, 2013

(54) SULFUR-CONTAINING INORGANIC MEDIA COATINGS FOR INK-JET APPLICATIONS

(75) Inventors: Steven D Looman, Wheaton, IL (US); Eric L Burch, San Diego, CA (US); John R Moffatt, Corvallis, OR (US); Gary Allan Ungefug, Corvallis, OR (US); Rolf Steiger, Praroman-le Mouret (CH); Pierre-Alain Brugger, Ependes (CH); Urs Fuerholz, Marly (CH)

(73) Assignee: Hewlett-Packard Development Company, L.P., Houston, TX (US)

( * ) Notice: Subject to any disclaimer, the term of this patent is extended or adjusted under 35 U.S.C. 154(b) by 881 days.

(21) Appl. No.: 12/203,897

(22) Filed: Sep. 3, 2008

(65) Prior Publication Data

US 2009/0004411 A1 Jan. 1, 2009

Related U.S. Application Data

(62) Division of application No. 10/774,920, filed on Feb. 6, 2004, now Pat. No. 7,435,448.

(51) Int. Cl.
*B41M 5/50* (2006.01)

(52) U.S. Cl. ..... 428/32.36; 428/32.3

(58) Field of Classification Search ..... None
See application file for complete search history.

(56) References Cited

U.S. PATENT DOCUMENTS

| | | | | |
|---|---|---|---|---|
| 6,447,881 | B1 | 9/2002 | Nishida et al. | |
| 6,551,695 | B2 * | 4/2003 | Kaneko et al. | 428/195.1 |
| 6,652,930 | B2 * | 11/2003 | Tsuchida et al. | 428/32.24 |
| 6,670,002 | B1 | 12/2003 | Sekiguchi et al. | |
| 2002/0071941 | A1 | 6/2002 | Tsuchida et al. | 428/195 |

FOREIGN PATENT DOCUMENTS

| | | | |
|---|---|---|---|
| EP | 1 195 259 | A2 | 4/2002 |
| EP | 1 329 332 | A2 | 7/2003 |

* cited by examiner

*Primary Examiner* — Bruce H Hess

(57) ABSTRACT

The present invention is drawn to a media sheet, comprising a substrate and a porous ink-receiving layer deposited on the substrate. The porous ink-receiving layer can comprise inorganic metal or semi-metal oxide particulates bound by a polymeric binder, and the porous ink-receiving layer can further include an effective amount of a sulfur-containing compound that interacts with ozone upon exposure thereto.

12 Claims, No Drawings

SULFUR-CONTAINING INORGANIC MEDIA COATINGS FOR INK-JET APPLICATIONS

CROSS-REFERENCE TO RELATED APPLICATIONS

This application is a divisional of U.S. application Ser. No. 10/774,920, filed on Feb. 6, 2004 now U.S. Pat. No. 7,435,448, the entire disclosure of which is hereby incorporated by reference.

FIELD OF THE INVENTION

The present invention is drawn to the reduction of the effect of ozone on ink-jet produced images. More specifically, the present invention is drawn to the incorporation of sulfur-containing compounds in inorganic media coatings to reduce image fade associated with exposure to ozone and other contaminants.

BACKGROUND OF THE INVENTION

There are several reasons that make ink-jet printing a popular way of recording images on various media surfaces, particularly paper. Some of these reasons include low printer noise, capability of high-speed recording, and multi-color recording. Additionally, these advantages can be obtained at a relatively low cost to consumers. However, though there have been great improvements in ink-jet printing, accompanying these improvements are increased consumer demands such as higher speeds, higher resolution, full color image formation, increased image durability, etc. As new ink-jet inks are developed, there are several traditional characteristics to consider when evaluating the ink in conjunction with printing media. Such characteristics include edge acuity and optical density of the image on the surface, dry time of the ink on the substrate, adhesion to the substrate, lack of deviation of ink droplets, presence of all dots, resistance of the ink after drying to water and other solvents, and long term storage stability. Though the above list of characteristics provides a worthy goal to achieve, there are difficulties associated with satisfying all of the above characteristics. Often, the inclusion of a media component to address one of the above attributes prevents another being met. Thus, most commercial media for use in ink-jet printers represent a compromise in an attempt to achieve adequate performance in all of the above listed attributes.

Ink-jet inks are either dye- or pigment-based. Dye-based ink-jet inks generally use water-soluble, mono-molecular colorants. As a result, such dye-based inks are usually not always water fast or stable to fade. Prints made from these inks tend to undergo color change over time, or fading, when exposed to ambient light and air. The media surface can play a key role in the fade properties and wet fastness of an image in that, for a given ink, the degree of fade and water fastness can be highly dependent on the chemistry of the media surface. Therefore, for optimum performance, many ink-jet inks often require that an appropriate media be selected in accordance with the application, thus reducing the choice of media.

In order for the ink-jet industry to effectively compete with silver halide photography and/or other applications, it is important that ink-jet prints must improve their image fade resistance. In other words, enhanced permanence of images has become important to the long-term success of photo-quality ink-jet ink technologies, as well as in other ink-jet ink technologies. In order to improve image permanence, it would be advantageous to reduce air fade that occurs due to the presence of air pollutants and other air constituents, such as ozone.

SUMMARY OF THE INVENTION

It has been recognized that it would be advantageous to provide coated ink-jet media that are resistant to air fade induced by the presence of pollution, including ozone exposure. As such, a media sheet can comprise a substrate and a porous ink-receiving layer deposited on the substrate. The porous ink-receiving layer can comprise inorganic metal or semi-metal oxide particulates bound by a polymeric binder. The porous ink-receiving layer can further include an effective amount of a sulfur-containing compound composition that interacts with ozone upon exposure thereto.

In another embodiment, a method of preparing a media sheet can comprise applying a porous ink-receiving layer to a media substrate, wherein the ink-receiving layer includes inorganic metal or semi-metal oxide particulates, polymeric binder, and an effective amount of a sulfur-containing compound that interacts with ozone upon exposure thereto. The method can further include a step(s) of drying the ink-receiving layer upon or after application.

In still another embodiment, an ink-jet print can comprise a coated media substrate and an ink-jet ink applied to at least a portion of the coated media substrate. The coated media substrate can include a substrate and a porous ink-receiving layer deposited on the substrate. The porous ink-receiving layer can comprise inorganic metal or semi-metal oxide particulates bound by a polymeric binder, and can further include a sulfur-containing compound. The ink-jet ink can be used to form an ink-jet image that is resistant to ozone exposure.

Additional features and advantages of the invention will be apparent from the following detailed description which illustrates, by way of example, features of the invention.

DETAILED DESCRIPTION OF THE PREFERRED EMBODIMENT(S)

Before the present invention is disclosed and described, it is to be understood that this invention is not limited to the particular process steps and materials disclosed herein because such process steps and materials may vary somewhat. It is also to be understood that the terminology used herein is used for the purpose of describing particular embodiments only. The terms are not intended to be limiting because the scope of the present invention is intended to be limited only by the appended claims and equivalents thereof.

As used in this specification and the appended claims, the singular forms "a," "an," and "the" include plural referents unless the content clearly dictates otherwise.

"Porous media" refers to any substantially inorganic particulate-containing coated media having surface voids and/or cavities capable of taking in the ink-jet inks of the present invention. Typically, porous media includes a substrate and a porous ink-receiving layer. As ink is printed on the porous media, the ink can fill the voids and the outermost surface can become dry to the touch in a more expedited manner as compared to traditional or swellable media. Common inorganic particulates that can be present in the coatings include silica (particularly silicates such as aluminum silicate) and alumina (particularly boehmite). Additionally, such coatings are typically bound together by a polymeric binder, and optionally, can include mordants or ionic binding species that are attractive of classes of predetermined dye species. In accordance with embodiments of the present invention, porous media coatings or ink-receiving layers of porous media include a sulfur-containing compound incorporated therein, or subsequently coated thereon.

The term "ink-receiving layer" does not require that the layer be a single layer. For example, an ink-receiving layer can include inorganic metal or semi-metal oxide particulates, polymeric binder, and a sulfur-containing compound applied as a single layer, or can include inorganic metal or semi-metal oxide particulates and polymeric binder present in a common coating application, and a sulfur-containing compound applied thereafter as an overcoat.

"Image permanence" refers to characteristics of an ink-jet printed image that relate to the ability of the image to last over a period of time. Characteristics of image permanence include image fade resistance, water fastness, humid fastness, light fastness, smudge resistance, air pollution resistance such as that induced by the presence of ozone, scratch and rub resistance, and inhibition of microbial growth. Improvement in any of these areas improves image permanence.

"Light fast" or "color fast" refers to the quality of a printed image. Images printed on the ink-jet ink media of the present invention tend to retain their color density and detail (as well as show significantly less fading) when exposed to light and/or air (air pollution resistance) as compared to a standard printed image.

"Humid fast" refers to the ability of a printed image to retain its image quality in damp conditions.

"Water fast" refers to resistance of movement of a colorant of an image when in contact with water.

"Air fade" refers to a phenomenon of fading of the brightness or chroma, or a hue shift of a printed image over time due to exposure to air contaminants and pollutants, e.g., ozone.

"Air fade resistance" describes the propensity of a printed image to resist fade due to exposure to air pollution or other air constituents.

"Media substrate" or "substrate" includes any substrate that can be used in the ink-jet printing arts including papers, overhead projector plastics or films, coated papers such as photobase, fabric, art paper such as water color paper, or the like.

In accordance with embodiments of the present invention, the incorporation of a sulfur-containing compound into or onto a media coating has been shown to improve air fade by preferentially reacting the sulfur-containing compound with ozone at a rate faster than ozone reacts with dyes or other colorants. Stated another way, if a sulfur-containing group is not hindered to potential oxidation, such a sulfur-containing group present within or on a media coating can preferentially react with the ozone over a colorant that may be present in an ink-jet ink printed thereon. In accordance with this, in a first embodiment of the present invention, a media sheet can comprise a substrate and a porous ink-receiving layer deposited on the substrate. The porous ink-receiving layer can comprise inorganic metal or semi-metal oxide particulates bound by a polymeric binder, and can further include an effective amount of a sulfur-containing compound that interacts with ozone upon exposure thereto. The sulfur-containing compound can be included within a coating composition used to form the ink-receiving layer, or can be applied as an overcoat, thereby becoming part of the ink-receiving layer. In one embodiment, it can be preferred that the sulfur containing compound be water soluble. In another embodiment, the atomic content of the sulfur can be greater than about 0.125% sulfur weight as compared to the weight of the inorganic particulate. In a more detailed aspect, the atomic content of the sulfur can be greater than about 0.4% sulfur weight as compared to the weight of the inorganic particulate.

In another embodiment, a method of preparing a media sheet can comprise applying a porous ink-receiving layer to a media substrate, wherein the ink-receiving layer includes inorganic metal or semi-metal oxide particulates, polymeric binder, and an effective amount of a sulfur-containing compound that interacts with ozone upon exposure thereto. The method can further include a step(s) of drying the ink-receiving layer. In one embodiment, the sulfur-containing compound can be admixed within a common coating composition with the inorganic metal or semi-metal oxide particulates and the polymer binder. Alternatively, the sulfur-containing compound can then be overcoated on a porous coating including the inorganic metal or semi-metal oxide particulates and the polymeric binder, thereby forming the ink-receiving layer.

In still another embodiment, an ink-jet print can comprise a coated media substrate and an ink-jet ink printed thereon. The coated media substrate can include a substrate and a porous ink-receiving layer deposited on the substrate. The porous ink-receiving layer can comprise inorganic metal or semi-metal oxide particulates bound by a polymeric binder, and can further include a sulfur-containing compound. The sulfur-containing compound can be applied as an overcoat with respect to the metal or semi-metal oxide particulates, or can be applied as a mixture therewith. The ink-jet ink can be applied to at least a portion of the coated media substrate to form an ink-jet image that is resistant to ozone exposure.

With respect to each of the above embodiments, there are many different sulfur-containing compounds that can be used to provide beneficial properties with respect to air fade resistance, and more specifically, ozone fade resistance. Exemplary sulfur-containing functionalities that can be used include, without limitation, thiols (—SH, e.g., thiodiethanol), thioethers (—S—, e.g., thiodiethyleneglycol), thioacids (e.g., thiodipropionic acid), thiol esters (—COS—, e.g., thiourea), thiones (—CS—, e.g., thiouracil), and sulfoxides (—SO—, e.g., thiophene). In one embodiment, a thiol or thioether compound can be used. The sulfur-containing compound in particular can be selected for its reactive properties with respect to ozone, or other contaminants, thereby reducing the affect of such contaminants on the colorant of the ink-jet ink to be applied thereto. To provide one example of a single mechanism regarding how ozone air fade can be reduced, one can consider thiols. Thiols typically can react with oxygenated species and oxidize quickly to sultones, sulfones, and eventually, to sulfoxides. Without being bound by any particular theory, because of the quick reaction between an oxygenated species and a thiol (or other sulfur-containing compound), the thiol can act to scavenge or consume the ozone before it has a chance to react adversely with the colorant, such as a dye, that is present in the ink-jet ink.

With respect to the media sheet embodiment, the method of preparing the media sheet embodiment, and the ink-jet print embodiment, there are several commonalities that can be implemented in accordance with the present invention. These and other embodiments are described hereinafter.

In accordance with aspects of the present invention, several systems, methods, coated media, and ink-jet prints are provided. With respect to each of these embodiments, the coated media itself typically includes a substrate and a porous ink-receiving layer deposited on the substrate. The substrate can be paper, plastic, coated paper, fabric, art paper, or other known substrate used in the ink-jet printing arts. In one embodiment, photobase can be used as the substrate. Photobase is typically a three-layered system comprising a single layer of paper sandwiched by two polymeric layers, such as polyethylene layers.

With respect to the porous ink-receiving layer, inorganic semi-metal or metal oxide particulates, polymeric binder, a sulfur-containing compound, and optionally, mordants and/or other coating composition agents can be present. In one embodiment, the inorganic semi-metal or metal oxide particulates can be silica, alumina, boehmite, silicates (such as aluminum silicate, magnesium silicate, and the like), titania, zirconia, calcium carbonate, and/or clays, and derivatives thereof. Typically, the particulates can be alumina, silica, or aluminosilicate. These inorganic particulates can be dispersed throughout a coating composition, which can be applied to a media substrate to form the porous ink-receiving layer. Typically, the inorganic particulates are present in the coating composition at from 60 wt % to 95 wt %. In two specific embodiments, boehmite can be present in the coating composition at from 85 wt % to 95 wt %, and silica or silicates can be present in the coating composition at from 75 wt % to 85 wt %.

In order to bind the inorganic particulates together in the coating composition, a polymeric binder is typically included. Exemplary polymeric binders that can be used include polyvinyl alcohol including water-soluble copolymers thereof; polyvinyl acetate; polyvinyl pyrrolidone; modified starches including oxidized and etherified starches; water soluble cellulose derivatives including carboxymethyl cellulose, hydroxyethyl cellulose; polyacrylamide including its derivatives and copolymers; casein; gelatin; soybean protein; silyl-modified polyvinyl alcohol; conjugated diene copolymer latexes including maleic anhydride resin, styrene-butadiene copolymer, and the like; acrylic polymer latexes including polymers and copolymers of acrylic and methacrylic acids, and the like; vinyl polymer latexes including ethylene-vinyl acetate copolymers; functional group-modified latexes including those obtained by modifying the above-mentioned polymers with monomers containing functional groups (e.g. carboxyl, amino, amido, sulfo, etc.); aqueous binders of thermosetting resins including melamine resins, urea resin, and the like; synthetic resin binders including polymethyl methacrylate, polyurethane resin, polyester resin, amide resin, vinyl chloride-vinyl acetate copolymer, polyvinyl butyral, and alkyl resins. Such binder can be present to bind the porous ink-receiving layer together, but can also be present in small enough amounts to maintain the porous nature of the porous ink-receiving layer. In accordance with embodiments of the present invention, the polymeric binder can be present in the coating composition at from 5 wt % to 40 wt %. In specific embodiments where boehmite is used, the polymeric binder can be present at from 3 wt % to 15 wt %; where silica or silicates are used, the polymeric binder can be present at from 10 wt % to 25 wt %. In a specific embodiment, the binder can be polyvinyl alcohol or derivatives thereof.

Optionally, the porous ink-receiving layer can also be modified with an ionic binding species or mordant known to interact with a predetermined class of dyes, thereby increasing permanence. Typical mordants that can be included in the coating composition, and thus included in the porous ink-receiving layer, when the colorant is anionic include hydrophilic, water dispersible, or water soluble polymers having cationic groups (amino, tertiary amino, amidoamino, pyridine, imine, and the like). These cationically modified polymers can be compatible with water-soluble or water dispersible binders and have little or no adverse effect on image processing or colors present in the image. Suitable examples of such polymers include, but are not limited to, polyquaternary ammonium salts, cationic polyamines, polyamidins, cationic acrylic copolymers, guanidine-formaldehyde polymers, polydimethyl diallylammonium chloride, diacetone acrylamide-dimethyldiallyl ammonium chloride, polyethyleneimine, and a polyethyleneimine adduct with epichlorhydrin. Aside from mordants, other optional components that can be present in the porous ink-receiving layer can include anionic surfactants, cationic surfactants, biocides, plasticizers, optical brighteners, viscosity modifiers, leveling agents, UV absorbers, hindered amine stabilizers, anti-ozonants, silane coupling agents, crosslinking agents, pH modifiers, or the like.

Incorporation of the sulfur-containing compound into a media coating can be by one of numerous methods. In one embodiment, one can include the sulfur-containing compound as an additive in the media coating formulation, or alternatively, one can incorporate the sulfur-containing compound into a silane coupling agent used to modify the surface of inorganic particulates, such as silica. A third method is through the use of doping or washing process after a coating layer has been formed. In this embodiment, an overcoat of a sulfur-containing compound can be applied to a pre-existing porous media coating to form an ink-receiving layer in accordance with embodiments of the present invention.

A major advantage of using a sulfur-containing compound as part of the ink-receiving layer is that many of such compounds, such as many thioethers, react with ozone to produce a product that is generally non-colored. In other words, unlike many other fade reduction additives (such as polyunsaturated fade inhibitors or amines), the use of thioethers does not cause the media to change color after it is consumed or otherwise reacted with ozone.

As mentioned, in one embodiment, sulfur-containing compound can be admixed with the coating compositions in accordance with the present invention to negate the effects of ozone exposure. In this embodiment, the sulfur-containing compound is included in an admixture of the inorganic metal or semi-metal oxide particulates, e.g., silica or alumina particulates, polymeric binder, and/or other optional ingredients that can be present. Exemplary optional ingredients that can be present include mordants, anionic surfactant, cationic surfactants, biocides, plasticizers, optical brighteners, viscosity modifiers, leveling agents, UV absorbers, hindered amine stabilizers, anti-ozonants, silane coupling agents, crosslinking agents, pH modifiers, or the like. In this embodiment, the sulfur-containing compound can be added to the liquid coating mix prior to application to the substrate and subsequent drying.

Also as mentioned, the sulfur-containing compound can be overcoated with respect to a coating composition including the inorganic metal or semi-metal oxide particulates and the polymeric binder. The overcoat composition can be applied by including the sulfur-containing compound in a solution as a wash coat.

A sulfur-containing compound can also be included in a coating composition by chemically modifying an inorganic particulate with the sulfur-containing compound. With this embodiment, the sulfur-containing compound can be configured to be at or near the surface of the inorganic particulate. Due to this configuration, a smaller amount of the sulfur-containing compound may be necessary for use to provide a desired result.

The following is given by way of example, illustrating possible sulfur-containing compounds, various reactive groups, and the optional spacer group that can be used in connection with the present invention, as illustrated in Formula 1 below:

IP-A-B-R Formula 1 where IP is an inorganic particulate, A is a reactive group, B is a spacer group, and R is at least one of many sulfur-containing compounds. Any reactive group can be used in accordance with the present invention, including those having the formula $SiX_3$, where each X can independently be halo, lower alkoxy, or a lower alkyl group (such as methyl, ethyl, propyl, or iso-propyl), with the proviso that at least one X must be reactive with silica, e.g., halo or lower alkoxy. Additionally, if a spacer group is present, any appropriate spacer group can be used to tether the sulfur-containing compound to the reactive group (and ultimately, the silica surface). Examples of appropriate spacer groups can include: $—(CH_2)_b—$, $—(CH_2)_bNH(C)O—$, $—(CH_2)_bO(CH_2)_a—$, or $—(CH_2)_bNH—$, where a is from 0 to 3 carbons, and b is from 1 to 10 carbons. A specific group of examples of compositions that can be used is exemplified in Formula 2 below:

$$R—(CH_2)_aO(CH_2)_bSiX_3 \qquad \text{Formula 2}$$

In the above example, R can be at least one of many sulfur-containing compounds, and each X can independently be halo, lower alkoxy, or a lower alkyl group (such as methyl, ethyl, propyl, or iso-propyl), with the proviso that at least one X must be reactive with silica, e.g., halo or lower alkoxy. A halo silane reactive group and/or a lower alkyl reactive group can be present, as represented by $—SiX_3$. The inorganic particulate portion, such as silica, is not shown, but can be reactive with one or more of the X groups. A spacer group is shown having the formula $—(CH_2)_aO(CH2)_b—$, wherein a can be from 0 to 3, and b can be from 1 to 10. Though the reactive group/lower alkyl group and spacer group is shown attached to a certain portion of the sulfur-containing compound, this is not intended to be limiting. All that is required is that the reactive group maintains its functionality for attaching to silica, and that the sulfur-containing compound maintains its functionality for interacting with ozone or other contaminants that cause air fade. In other words, any means or point of attachment (through a spacer group or without a spacer group) between the sulfur-containing compound and the reactive group can be used, provided the aforementioned functionalities can be maintained. Further, though a specific type of spacer group is shown, other spacer groups can be used, as would be known by one skilled in the art after reading the present disclosure.

In this particular embodiment, the reason that there must be at least one reactive group is so the sulfur-containing compound can be covalently attached to the silica (not shown) to form the coating material. Though a sulfur-containing compound functionalized with a specific type of reactive group attached through a silane group is shown, other reactive groups can also be attached to silica or another inorganic particulate, as would be known by those skilled in the art after considering the present disclosure.

Silica, as an example, can be modified with sulfur-containing compound according to the following general method. A thioether composition is described in this embodiment. The silica is dried in a vacuum at an elevated temperature to remove adsorbed moisture and allowed to cool to room temperature. The solvent in which the reaction is to be carried out is also dried with an appropriate drying agent. Common solvents that can be used include toluene, dichloromethane, isopropanol, and/or methanol. The dried silica is taken into the dry solvent (or it may be dispersed in the solvent by sonication). The amount of solvent used should be selected such that the thioether-containing reagent concentration (when added) does not generally exceed about 10%. The vessel containing the silica and solvent mixture may be flushed with dry nitrogen, and then the reagent (which includes the thioether), e.g., lower alkoxy or halo silane functionalized with a thioether compound, is introduced into the reaction vessel. The amount of reagent added depends on the surface area, and the surface silanol concentration of the silica and the molecular weight of the reagent. When selecting the reaction conditions, one should consider its reactivity. For example, alkoxy silanes are less reactive than halo silanes. Thus, reaction times and temperatures are adjusted after considering the reagent used. Typically, about six hours or more of refluxing under dry nitrogen can be required. If carried out at room temperature rather than at elevated temperatures, longer reactions times may be necessary. After the reaction is completed, the product is filtered and washed with excess solvent and dried. This general procedure can be carried out to prepare the coating material for use with the present invention. This reaction may also be carried out without the use of excess reagent, thus eliminating the need to remove excess reagent by washing. Methanol is a preferred solvent that can be used, and small amounts of it may remain in the product since it is miscible with water. Water itself is another solvent that can be used, in which case the reaction kinetics and yield can be optimized through pH adjustment. In an alternative embodiment, a wash method can also be used to modify the silica.

The application of an ink-receiving layer to a media substrate can be the result of applying a single coating layer, or multiple coating layers. For example, in embodiments where the sulfur-containing compound is attached to the inorganic metal or semi-metal oxide particulates, or alternatively, is admixed with the inorganic metal or semi-metal oxide particulates, a single coating layer can be formed. Alternatively, multiple coating layers can be formed when the sulfur-containing compound is applied as an overcoat with respect to an under layer coating composition containing the inorganic metal or semi-metal oxide particulates. With respect to the single layer embodiment, or an under layer of the multiple layer embodiment, any of a number of coating methods known in the art can be used, including the use of an air knife coater, a blade coater, a gate roll coater, a doctor blade, a Meyer rod, a roller, a reverse roller, a gravure coater, a brush applicator, a sprayer, and the like. Further, drying of the coating may be effected by conventional means such as hot air convection, microwave, infrared heating, or open air drying. In further detail with respect to embodiments where the sulfur-containing compound is applied as an overcoat, application can be by any of a number of methods, such as by a wash coat method.

EXAMPLES

The following examples illustrate various aspects of coatings for porous ink-jet ink media substrates. The following examples should not be considered as limitations of the invention, but should merely teach how to make the best coatings, reflecting the present invention.

Example 1

Preparation of Silica Dispersion

A silica dispersion for inclusion in a coating composition can be prepared in accordance with the following procedure. To 482.2 parts by weight of deionized water is added 21.9 parts by weight of 2N KOH (102.5 g/kg solids). The KOH is mixed with high lift with a paddle blade mixer until dissolved. To the resulting solution is added 58.5 parts by weight of an aluminum chlorohydrate solution (Locron) (477 g/kg solids)

under constant mixing. A 213.4 parts by weight of silica (Cabot M5, 1000 g/kg solids) is also added portion-wise using a paddle blade mixer until wet. Once the silica is wetted, the composition is mixed under high shear until substantially fully dispersed. Next, the mixing is changed to a gentle mixing setting and the composition is warmed to 60° C. overnight. After reacting overnight, 224.1 parts by weight of boric acid (40 g/kg solids) is then added to the dispersion to finish the silica dispersion composition.

Example 2

Preparation of Coating Composition

A coating composition used to prepare an ink-receiving layer can be prepared in accordance with the following procedure. To 84.8 parts by weight of deionized water (45° C.) is added 305 parts by weight of Mowiol 2688 (polyvinyl alcohol) (100 g/kg solids) under gentle mixing. To this composition is added 2.9 parts by weight of glycerin (500 g/kg solids), 28.5 parts by weight of p-isononylphenoxypoly (glycidol) also known as Olin-10G (108.9 g/kg solids), and 7 parts by weight of 2,2-thiodiethanol (TDEG) (500 g/kg solids) under continued mixing. Next, 571.7 parts by weight of the silica dispersion prepared in accordance with Example 1 (213.4 g/kg solids) is then added under continued mixing to form the coating composition.

Example 3

Coating Composition Applied to a Media Substrate

The coating composition prepared in accordance with Example 2 can be applied to a media or other substrate using a Meyer rod at a delivery rate of 27 gsm. The coated substrate can then be dried in an oven at 60° C.

Example 4

Print Test Results

Test media sheets are prepared in accordance with Example 3. Additionally, control media sheets are prepared in accordance with Example 3, except that the TDEG is removed from the formulation. Diagnostic images are printed on the test media sheets and the control media sheets using an HP 6540 desktop printer having a photo pen. The diagnostic prints are used to evaluate fade as measured by OD change for both types of media sheets. Samples are tested by exposing both print types to 3.5 ppm $O_3$ at 30° C. and 50% relative humidity. The test media containing TDEG yielded improved fade behavior compared to the control media, as set forth in Table 1 below:

TABLE 1

| Media Sample | TDEG (% vs. fumed silica) | Induction period (days) | 40% OD loss |
|---|---|---|---|
| Test media (thiol present) | 3.3 | 2 | 3 |
| Control Media (no thiol present) | 0 | 0.1 | 0.9 |

Example 5

Preparation of Silica Dispersion

A silica dispersion for inclusion in a coating composition can be prepared in accordance with the following procedure. To 100 ml of deionized water is 800 mg of 3-mercaptopropyltrimethoxylilane (Gelest) under constant mixing. Next, 20 g of fumed silica is added under continued agitation using a stator-rotary disperser for 30 minutes. The mixing is changed to a gentle mixing setting and the composition is allowed to react overnight. A 20% dispersion of silica is formed that can be used in a coating composition in accordance with embodiments of the present invention.

Example 6

Preparation of Coating Composition

A coating composition is prepared in accordance with Example 2, except that the silica dispersion included is provided as prepared in Example 5 rather than in Example 1, and TDEG is not added to the coating composition.

Example 7

Coating Composition Applied to a Media Substrate

The coating composition prepared in accordance with Example 6 can be applied to a media or other substrate using a Meyer rod at a delivery rate of 27 gsm. The coated substrate can then be dried in an oven at 60° C.

Example 8

Application of Wash Coats

To four separate media sheets prepared in accordance with Example 7 is applied a different wash coat coating solution. Specifically, (1) a first media sheet is modified with a control wash coat containing 0 wt % TDEG; (2) a second media sheet is modified with a wash coat of containing 2 wt % solids solution of TDEG; (3) a third media sheet is modified with a wash coat containing 3.6 wt % solids of TDEG; and (4) a fourth media sheet is modified with a wash coat containing 2 wt % solids of DEG. The media sheets are each dried for 20 minutes at 40° C. Media sheets 1 and 4 are prepared as control samples, as neither included a sulfur-containing compound.

Example 9

Print Test Results

To each of media sheets 1-4 prepared in accordance with Example 8 is applied diagnostic images using an HP 6540 desktop printer having a photo pen. The diagnostic prints are used to evaluate fade as measured by OD change for each prepared media sheet type. Specifically, the samples are printed with magenta and cyan color patches at 0.5 OD. Each of the four samples is then placed in a Hampden 903B ozone chamber set at 25° C., 50% relative humidity, and 1 ppm ozone. The samples are checked for OD loss at various hourly increments. Table 2 below shows the OD loss as a function of the thiol level, or lack of thiol.

TABLE 2

| Media Sample | Color | OD loss at 8 hrs | OD loss at 16 hrs | OD loss at 24 hrs |
|---|---|---|---|---|
| 0 wt % TDEG (no thiol present) | magenta | 3.3 | 6.0 | 8.3 |
| 0.5 gsm TDEG (thiol present) | magenta | 0.6 | 3.2 | 5.6 |

TABLE 2-continued

| Media Sample | Color | OD loss at 8 hrs | OD loss at 16 hrs | OD loss at 24 hrs |
|---|---|---|---|---|
| 0.9 gsm TDEG (thiol present) | magenta | −0.6 | 1.9 | 4.0 |
| 0.5 gsm DEG (no thiol present) | magenta | 3.7 | 6.5 | 8.6 |
| 0 wt % TDEG (no thiol present) | cyan | 2.3 | 5.4 | 6.5 |
| 0.5 gsm TDEG (thiol present) | cyan | 1.3 | 2.8 | 4.1 |
| 0.9 gsm TDEG (thiol present) | cyan | 0.4 | 1.7 | 3.2 |
| 0.5 gsm DEG (no thiol present) | cyan | 2.7 | 4.2 | 5.2 |

As can be seen by Table 2, the air fade exposure test revealed that, relative to the media sheets that did not contain a sulfur-containing compound, the inks printed on the thiol-coated media sheet significantly outperformed the media sheets that are unmodified with a thiol composition. Even the addition of DEG in control media sheet 4 had very little effect preventing fade relative to 0 wt % solids TDEG control media sheet 1. Also, as apparent by the data present in Table 2, the increasing of TDEG decreased the amount of fade for both cyan and magenta color patches.

It is to be understood that the above arrangements and Examples are only illustrative of the present invention. Numerous modifications and alternative arrangements can be devised without departing from the spirit and scope of the present invention. While the present invention has been described by examples and fully described above with particularity and detail in connection with what is presently deemed to be the most practical and preferred embodiment(s) of the invention, it will be apparent to those of ordinary skill in the art that numerous modifications can be made without departing from the principles and concepts of the invention as set forth in the claims.

What is claimed is:

1. A media sheet, comprising:

a substrate; and a porous ink-receiving layer deposited on the substrate, said porous ink-receiving layer comprising inorganic metal oxide or semi-metal oxide particulates bound by a polymeric binder, said porous ink-receiving layer further including an effective amount of a sulfur-containing compound that interacts with ozone upon exposure thereto, wherein at least a portion of the sulfur-containing compound is chemically attached to at least one of the inorganic metal oxide or semi-metal oxide particulates.

2. A media sheet as in claim 1, wherein the substrate is photobase.

3. A media sheet as in claim 1, wherein the porous ink-receiving layer further comprises a mordant component configured for fixing a predetermined class of colorant.

4. A media sheet as in claim 1, wherein the inorganic metal oxide or semi-metal oxide is silica.

5. A media sheet as in claim 1, wherein the inorganic or semi-metal oxide is alumina.

6. A media sheet as in claim 1, wherein the polymeric binder is selected from the group consisting of polyvinyl alcohol, water-soluble copolymers of polyvinyl alcohol, polyvinyl acetate, polyvinyl pyrrolidone, oxidized starches, etherified starches, carboxymethyl cellulose, hydroxyethyl cellulose, polyacrylamide, polyacrylamide derivatives, polyacrylamide copolymers, casein, gelatin, soybean protein, silyl-modified polyvinyl alcohol, maleic anhydride resin, styrene-butadiene copolymer, copolymers of acrylic and methacrylic acids, ethylene-vinyl acetate copolymers, carboxyl-modified latexes, amino-modified latexes, amido-modified latexes, sulfo-modified latexes, melamine resin, urea resin, polymethyl methacrylate, polyurethane resin, polyester resin, amide resin, vinyl chloride-vinyl acetate copolymer, polyvinyl butyral, alkyl resins, and combinations thereof.

7. A media sheet as in claim 1, wherein the sulfur-containing compound is admixed within the porous ink-receiving layer.

8. A media sheet as in claim 1, wherein the sulfur-containing compound is selected from the group consisting of a thioether and a thiol.

9. A media sheet as in claim 8, wherein the sulfur-containing compound is a thiodiethanol.

10. A media sheet as in claim 1, wherein the media sheet is printed with ink and provides an optical density loss of less than 1 after 8 hours.

11. A media sheet as in claim 1, wherein the media sheet is printed with ink and provides an optical density loss of less than 3 after 16 hours.

12. A media sheet as in claim 1, wherein the media sheet is printed with ink and provides an optical density loss of less than 5 after 24 hours.

* * * * *